United States Patent [19]

Axlander

[11] 4,330,577

[45] May 18, 1982

[54] HEAT EXCHANGER WALL ELEMENT COMPRISING NATURAL FIBER MATERIAL DRENCHED FIRST WITH A SALT SOLUTION AND THEREAFTER WITH A WATER GLASS BINDER

[76] Inventor: Axel N. A. Axlander, Floragatan 10, S-114 31 Stockholm, Sweden

[21] Appl. No.: 142,923

[22] Filed: Apr. 23, 1980

[30] Foreign Application Priority Data

May 21, 1979 [SE] Sweden ..... 7904440

[51] Int. Cl.[3] ..... B05D 1/36; B32B 1/08; F28F 13/18; F28F 19/02

[52] U.S. Cl. ..... 428/36; 138/146; 165/133; 165/134 R; 165/177; 427/230; 427/236; 427/372.2; 427/384; 427/404; 427/419.1; 427/419.2; 427/430.1

[58] Field of Search ..... 165/133, 134 R, 177; 138/146; 55/524, 527, 528; 428/36; 427/230, 236, 372.2, 384, 404, 419.1, 419.2, 430.1

[56] References Cited

FOREIGN PATENT DOCUMENTS 2353036 12/1977 France .

*Primary Examiner*—James C. Cannon

*Attorney, Agent, or Firm*—Pollock, Vande Sande & Priddy

[57] ABSTRACT

A porous, hygroscopic heat exchanger wall element particularly consisting of a natural fiber material. The wall element is drenched with a salt solution, the salt is retained in the pores by means of an adhesive, such as water glass, and the wall element is preferably also drenched with glycerine and a fine grain metal powder for further reduction of the freezing point and improved heat transfer.

13 Claims, 1 Drawing Figure

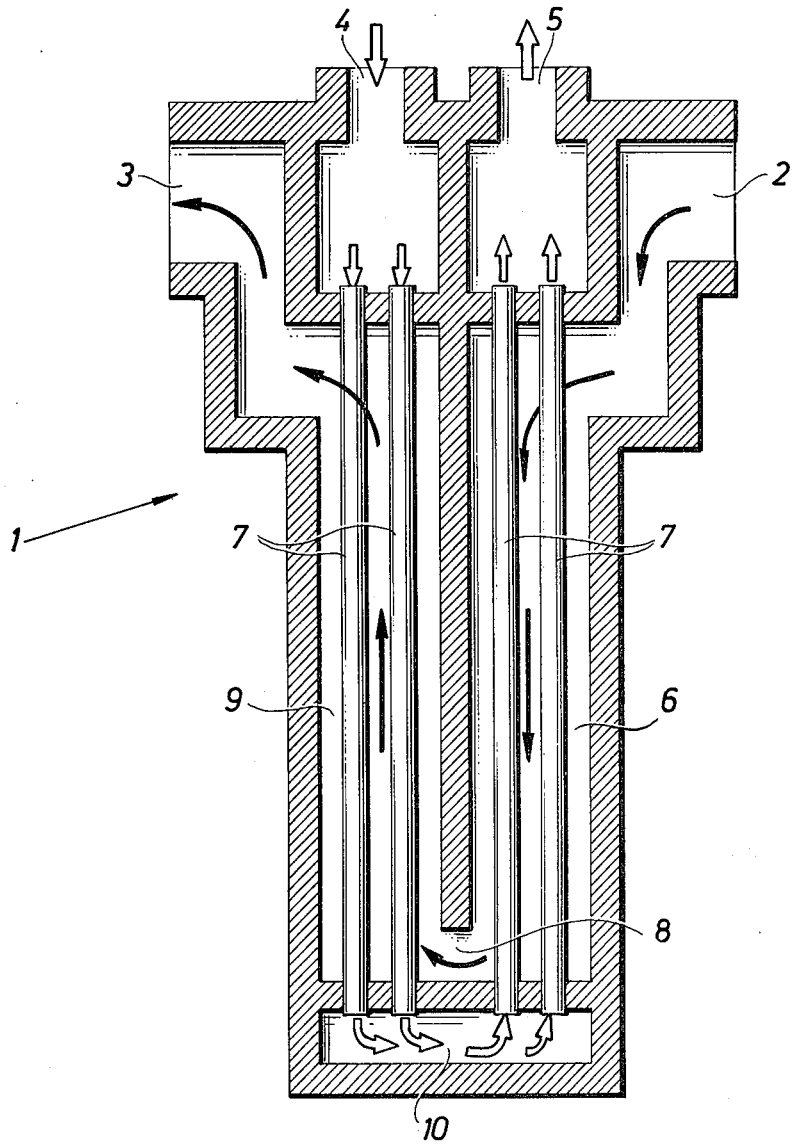
4
5
3
2
1
7
7
9
6
8
10

HEAT EXCHANGER WALL ELEMENT COMPRISING NATURAL FIBER MATERIAL DRENCHED FIRST WITH A SALT SOLUTION AND THEREAFTER WITH A WATER GLASS BINDER

BACKGROUND OF THE INVENTION

The invention relates to a porous, hygroscopic heat exchanger wall element and a method of manufacturing the same.

Swedish Patent Application No. 7606060-7 discloses a heat and humidity exchanger having porous, tubular partition wall elements, particularly in the form of textile felt hoses, which partition wall elements separate flow passages of two gas flows, particularly air flows, having different temperatures and/or humidity contents. The partition wall elements are vertically arranged and communicate at the top and the bottom with an upper and a lower salt solution bath, respectively, whereby the partition wall element is kept constantly drenched with salt in its pores so as to prevent the deposit of ice and impurities in and on the partition wall element.

Such an arrangement with two different salt solution baths is rather complicated and the object of the present invention is to achieve a heat exchanger wall element, where permanent salt solution baths are superfluous, but effective defrosting and purifying action is maintained. Furthermore, the heat conductivity through the wall element should be as good as possible, and the wall element, despite its porosity, should be tight enough to prevent the transfer of ill-smelling and unhealthy substances from one gas flow (e.g., exhaust air) to the other (e.g., inflow air) in the heat exchanger.

SUMMARY OF THE INVENTION

These objects are achieved by a wall element and a method of manufacture, respectively, according to the invention, the features of which are stated in the appended claims.

BRIEF DESCRIPTION OF THE FIGURE

The invention is described in detail below with reference to the attached FIGURE schematically showing a central section through a heat exchanger having wall elements according to the invention.

DETAILED DESCRIPTION OF A PREFERRED EMBODIMENT

The FIGURE shows schematically a heat exchanger casing 1 comprising inlet and outlet openings 2 and 3, respectively, for a first gas flow (e.g., inflow air) and corresponding inlet and outlet openings 4 and 5, respectively, for a second gas flow (e.g., exhaust air).

From the inlet opening 2, the first gas flow flows downwards into a first, essentially vertical shaft 6 at the outside of hoses 7 arranged therein (and forming the partition wall elements of the heat exchanger), and thereafter horizontally through a passage 8 and upwards through a second vertical shaft 9 at the outside of additional, similar hoses 7 and out through the outlet opening 3 (see the single arrows in the drawing FIGURE). Simultaneously, the second gas flow flows in the opposite direction from the inlet opening 4 downwards through the hoses 7 in said second shaft 9, and horizontally through a lower chamber 10 and upwards through the hoses 7 in the shaft 6 and out through the outlet opening 5 (see the double arrows in the FIGURE).

As appears from the FIGURE, the hoses 7, serving as partition walls elements, are permanently arranged in the heat exchanger casing 1. These hoses 7 do not contact any solution bath (Cf. heat exchanger known from the above-mentioned Swedish application). Nevertheless, the hoses made of a porous, hygroscopic material, particularly a natural fiber material such as cotton, flax or wool, and are kept constantly drenched with salt so as to prevent the deposit of ice and impurities on the hose walls.

According to the invention, this is made possible by drenching the hoses also with an adhesive, particularly water glass, whereby the salt is retained in the pores of the hoses material. For a further freezing point reduction and salt binding, it has proven advantageous to have the hoses drenched also with glycerine. Moreover, the hoses may be impregnated with a fine grain metal powder, e.g., Al or Cu powder, which improves heat transfer between the two gas flows (through heat conduction in the hose wall), and also makes the hose wall tighter, thereby preventing transmission of ill-smelling or unhealthy substances through the hose wall.

As mentioned above, the hoses preferably consist of a natural fiber material and thus are microporous. According to the invention they are treated as follows:

Firstly, they are dipped into a bath containing a sodium chloride solution of about 27%, whereafter they are left to drain while being blown through by hot air, so that an even distribution of salt in the hose material is secured. The hoses are then dipped into a water solution containing about 20% water glass, about 50% glycerine and intermixed metal powder, e.g., a fine grain Al or Cu powder. To keep the powder homogenous in the water bath and prevent the same from sedimentation, it should be stirred. Alternatively, the liquid sludge can be sprayed onto the hoses, e.g., in the heat exchanger itself after the same has been in operation for a longer period of time. It is also conceivable to arrange the hoses in the apparatus in an easily exchangeable way.

The hoses treated according to the invention have proven to function extremely well, and no deposit of ice occurs even at temperatures as low as −30° C. Moreover, they are rather soft and can easily be folded or wound for packing and transportation. The second drenching step may possibly be effected or repeated after transportation or packing.

Naturally, the invention is applicable to porous wall elements other than hose shaped ones. The essential feature is to bind the salt in the pores of the partition wall element by means of the treatment described above. It is not necessary to arrange the partition wall element in a vertical position, since the salt is effectively retained irrespective of the orientation of the wall element.

I claim:

1. A heat exchanger wall element of porous hygroscopic material consisting of natural fiber material drenched with a salt solution for reducing the freezing point of water, characterized in that said salt-drenched wall element has also been drenched with water glass in order to retain the salt in the pores of said wall element during use thereof.

2. A heat exchanger wall element according to claim 1, wherein said wall element has also been drenched with glycerine.

3. A heat exchanger wall element according to claim 1, wherein said wall element has been drenched with a water solution containing about 20% water glass and about 50% glycerine.

4. A heat exchanger wall element according to any one of claims 2 or 3, wherein said wall element has also been impregnated with a fine grain metal powder.

5. A heat exchanger wall element according to claim 4, wherein said powder is aluminum powder.

6. A heat exchanger wall element according to claim 4, wherein said powder is copper powder.

7. A method of manufacturing a heat exchanger wall element of porous hygroscopic material consisting of natural fiber material, comprising the steps of (a) first drenching said wall element with a salt solution for reducing the freezing point of water; and then (b) drenching said wall element with water glass in order to retain the salt in the pores of said element.

8. A method according to claim 7, wherein said salt solution is a sodium chloride solution.

9. A method according to claim 7, wherein said water glass is contained in a water solution.

10. A method according to claim 9, wherein said water solution also contains glycerine.

11. A method according to claim 9, wherein said water solution is mixed with fine grain aluminum powder.

12. A heat exchanger wall element according to claim 9, wherein said water solution is mixed with fine grain copper powder.

13. A method according to claim 7, wherein said wall element is left to drain after being drenched with said salt solution and before being drenched with said water solution.

* * * * *